United States Patent [19]

Bochan

[11] 4,091,644

[45] May 30, 1978

[54] TURBINE PUMP

[75] Inventor: John Bochan, Louisville, Ky.

[73] Assignee: General Electric Company, Louisville, Ky.

[21] Appl. No.: 785,936

[22] Filed: Apr. 8, 1977

[51] Int. Cl.[2] ..... D06F 29/00

[52] U.S. Cl. ..... 68/18 F; 68/23.7; 68/184; 415/146; 415/152 A

[58] Field of Search ..... 415/146, 147, 152 A; 68/23.5, 23.7, 184, 208

[56] References Cited

U.S. PATENT DOCUMENTS

| | | | |
|---|---|---|---|
| 2,838,002 | 6/1958 | Cohen | 415/146 |
| 2,883,843 | 4/1959 | Bochan | 68/23.5 |
| 3,127,840 | 4/1964 | Bochan | 415/146 |

*Primary Examiner*—Clarence R. Gordon
*Attorney, Agent, or Firm*—Frederick P. Weidner; Francis H. Boos

[57] ABSTRACT

A reversible turbine pump for producing bi-directional liquid flow wherein there is provided a housing having a substantially annular outer wall and top and bottom walls closing the ends of the outer wall. Within the housing there is a rotatable impeller having an annular series of blades extending outwardly and forming with the wall a toroidal space. First and second spaced outlet openings are provided in the housing and also first and second circumferentially spaced channels between the impeller and each of the outlet openings in liquid flow communication with the toroidal space. A dam is located between the channels. An inlet opening is located in each of the channels. Each of the inlet openings has a flapper check valve arranged to open and permit liquid to flow through the inlet opening in one direction of rotation of the impeller and close to prevent the flow of liquid through the opening in the opposite direction of rotation of the impeller, one of the flapper check valves being open when the other is closed during impeller rotation. The inlet openings are dimensioned such that flow of liquid through the opening is in a volume greater than the capacity of the impeller to move the liquid through the toroidal space. There is also provided a liquid reservoir to supply liquid to the inlet openings in a volume at least equal to the inlet opening liquid flow through volume.

16 Claims, 5 Drawing Figures

FIG.2
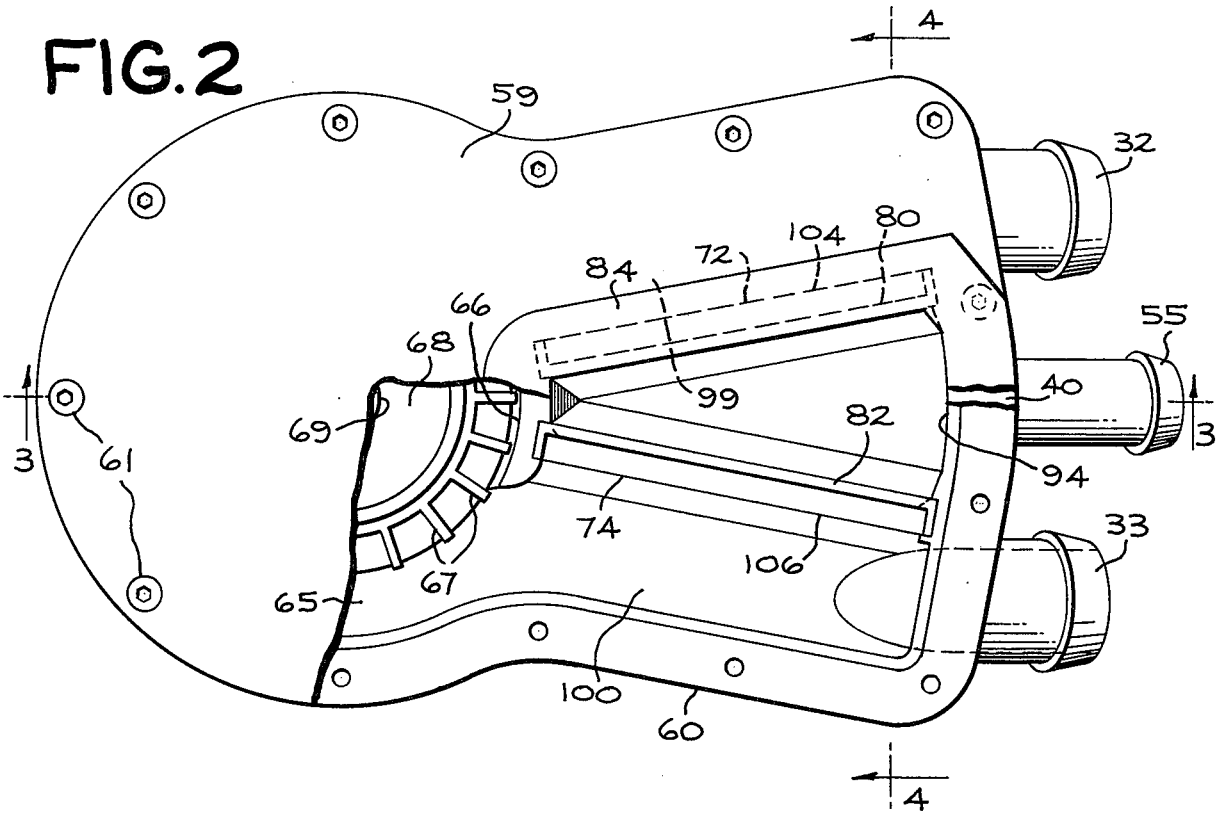
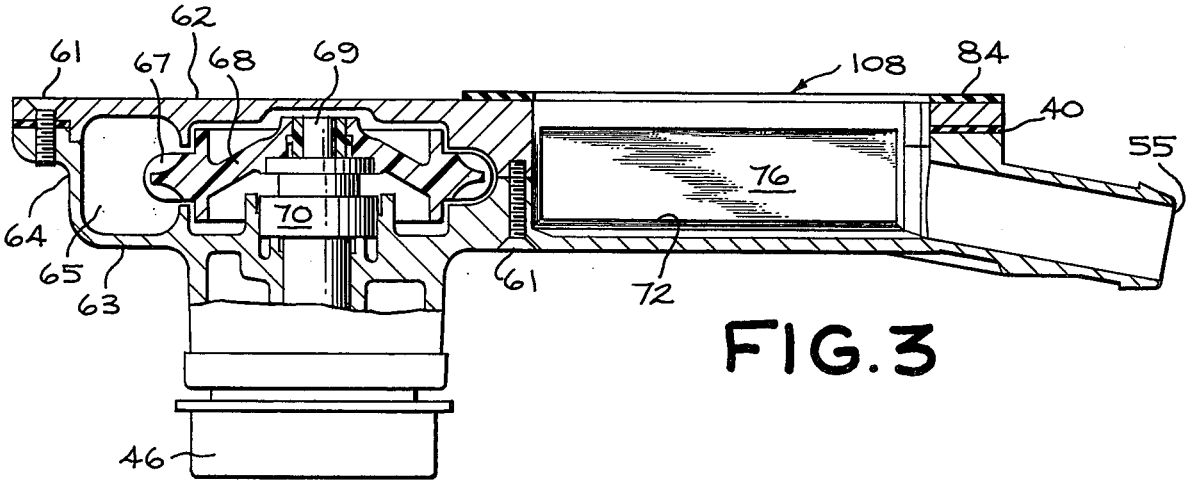
FIG.3
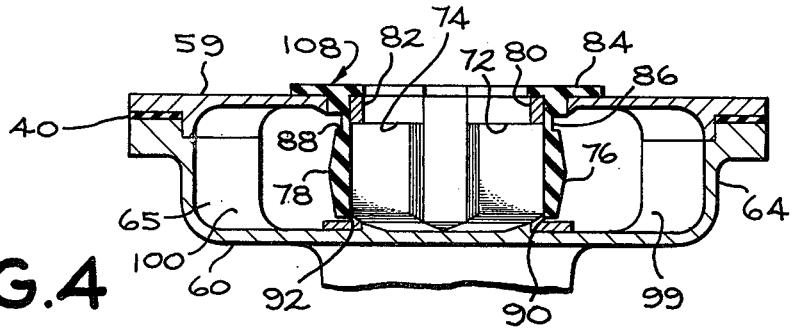
FIG.4

TURBINE PUMP

BACKGROUND OF THE INVENTION

1. Field of the Invention

This invention relates to turbine pumps and more particularly to an improved reversible turbine pump for use in an automatic clothes washing machine.

2. Description of the Prior Art

Automatic clothes washing machines virtually always include a drain pump which is put into operation in order to effect draining of liquid from the machine after washing and rinsing operations. This pump is generally operated by the same power source, usually an electric motor, which operates the washing system of the machine so that the motor will, by reversing rotation, alternatively provide a washing action in the machine or serve to drain liquid out of the machine. An additional function which has been provided in several commercially available washing machines in recent years is recirculation of the wash liquid during the washing operation, usually for filtering purposes.

Various factors, including the ability to pass small rigid articles carried out by wash water, durability, serviceability, and the like, have led to a general trend in the washing machine industry to utilize turbine type pumps for the removal of the liquid from the machine, as opposed to centrifugal type pumps. It is well known that, with a turbine type pump, direction of flow through the pump can be reversed simply by reversing the rotation of the pump impeller, as opposed to centrifugal type pumps wherein flow necessarily is always in a generally radially outward direction through the pump.

Various types of turbine pumps have been utilized in the past in particular in connection with clothes washing machines. An example of such a turbine pump is disclosed in U.S. Pat. No. 3,127,840 issued in the name of the present inventor and assigned to the same assignee as the present invention. Examples of other turbine pumps are shown in U.S. Pat. Nos. 2,838,002; 2,883,843; 2,961,967; and 3,127,839. All of these turbine pumps have attempted to at least partially resolve the inherent problem of the pump sucking air through one of the outlet openings when the impeller is reversed. Various check valve means have been proposed including those disclosed in U.S. Pat. Nos. 2,838,002; 2,883,843; 2,961,967; 3,127,839; and 3,127,840. In these various arrangements, however, the success of preventing the pump from sucking air through one of the outlets when the liquid flow is through the other outlet has not been entirely successful primarily because of the increased power used by the pump.

By my invention I have improved the turbine pump in that by my structural arrangement the pump may be operated in either of the two directions and does not suck air through the outlet openings of the pump. Thus the efficiency of the pump is maintained and the noise resulting from sucking air through the outlet openings is eliminated. These features are highly desirable, particularly when the turbine pump is to be used in a clothes washing machine.

SUMMARY OF THE INVENTION

There is provided a reversible turbine pump for producing bi-directional liquid flow particularly for use in an automatic clothes washing machine. The turbine pump includes a housing having a substantially outer wall and top and bottom walls closing the ends of the outer wall. A bi-directional rotatable impeller within the housing has an annular series of blades extending outwardly and forming with said wall of the housing a substantially toroidal space. The turbine pump has first and second spaced outlet openings and first and second circumferentially spaced channels between the impeller and each of the outlet openings in liquid flow communication with the toroidal space. There is also provided a dam between the channels. The turbine pump also includes an inlet opening located in each of the channels between the impeller and the respective first and second outlets. Each of the inlet openings has a flapper check valve arranged to open and permit liquid flow through the inlet opening in one direction of rotation of the impeller and close to prevent the flow of liquid through the opening in the opposite direction of rotation of the impeller, one of said flapper check valves being open when the other is closed during impeller rotation. The inlet openings are dimensioned such that the flow of liquid therethrough is in a volume greater than the capacity of the impeller to move the liquid through the toroidal space. There is also provided a liquid reservoir which is arranged to supply liquid to the inlet openings in a volume at least equal to the inlet opening liquid flow through volume. By this turbine pump arrangement air is not introduced into the toroidal space from the outlet openings when the pump is in operation.

BRIEF DESCRIPTION OF THE DRAWINGS

FIG. 2 is a top plan view of the turbine pump of this invention partially broken away;

FIG. 3 is a partially sectionalized side elevational view of the turbine pump of this invention taken along lines 3—3 of FIG. 2;

FIG. 4 is a view taken along line 4—4 of FIG. 2; and

DESCRIPTION OF THE PREFERRED EMBODIMENT

Figure 1:
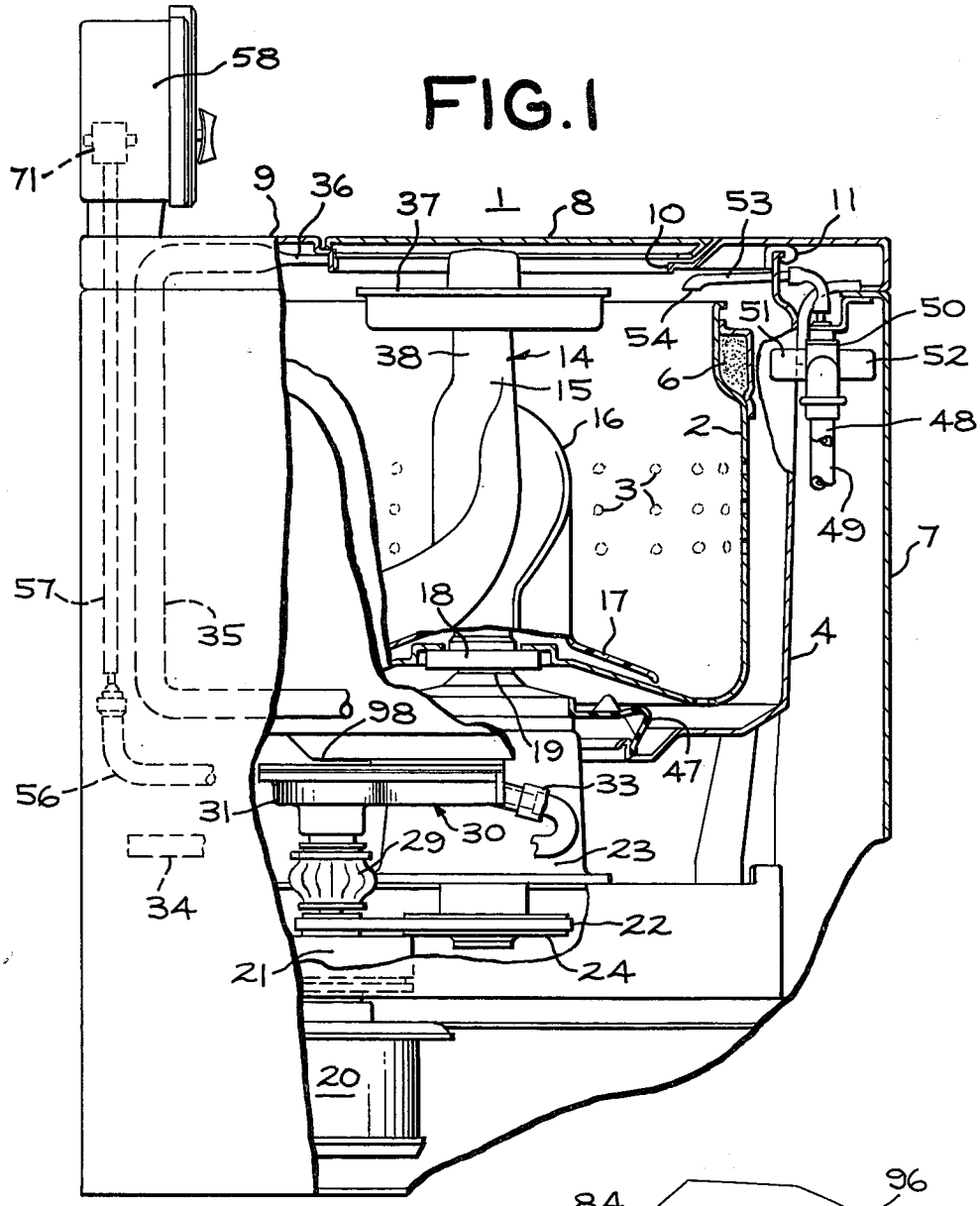
FIG. 1 is a side elevational view of a clothes washing machine including my turbine pump, the view being partially broken away and partially in section to illustrate details.

Referring now to FIG. 1, I have shown therein an agitator type clothes washing machine 1 having a conventional basket or clothes receiving receptacle 2 provided over its side and bottom walls with perforations 3 and disposed within an outer imperforate tub or casing 4. The basket 2 may be provided with a balance ring 6 to help steady the basket when it is rotated at high speed.

Tub 4 is rigidly mounted within an appearance cabinet 7 which includes a cover 8 hingedly mounted in the top portion 9 of the cabinet for providing access through an opening 10 to the basket 2. As shown, a gasket 11 may be provided so as to form a seal between the top of tub 4 and portion 9 of the cabinet thereby to prevent escape of moisture and moist air into the cabinet around the tub. The rigid mounting of tub 4 within the cabinet 7 may be effected by any suitable means. At the center of basket 2 there is positioned a vertical axis agitator 14 which includes a center post 15 and a plurality of curved water circulating vanes 16 joined at their lower ends by an outwardly flared skirt 17. Both the clothes basket 2 and the agitator 14 are rotatably mounted. The basket is mounted on the flange 18 of a rotatable hub 19 and the agitator 14 is mounted on a shaft (not shown) which extends upwardly through the hub 19 and through the center post 15 and is secured to the agitator so as to drive it.

During the cycle of operation of the machine 1, water is introduced into the tub 4 and basket 2, and the agitator 14 is then oscillated back and forth on its axis, that is, in a horizontal plane within the basket to wash the clothes therein. Then after a predetermined period of this washing action, basket 2 is rotated at high speed to extract centrifugally the washing liquid from the clothes and to discharge it to drain. Following this extraction operation, a supply of clean liquid is introduced into the tub and basket for rinsing the clothes and the agitator is again oscillated. Finally the basket is once more rotated at high speed to extract the rinse water.

The basket 2 and agitator 14 are driven through suitable means from a reversing motor 20 through a drive including a clutch 21 mounted on the motor shaft. Clutch 21 may conventionally allow the motor to start without a load and then accept the load as it comes up to speed. A suitable belt 22 transmits power to a transmission assembly 23 through a pulley 24. Thus, depending upon the direction of motor rotation, the pulley 24 of transmission 23 is driven in opposite directions.

The transmission 23 is so arranged that it supports and drives both the agitator drive shaft and basket mounting hub 19. When motor 20 is rotated in one direction the transmission causes agitator 14 to oscillate in a substantially horizontal plane within the basket 2. Conversely, when motor 20 is driven in the opposite direction, the transmission rotates the wash basket 2 and agitator 14 together at high speed for centrifugal liquid extraction.

In addition to operating the transmission 23 as described, motor 20 also provides a direct drive through a flexible coupling 29 to a pump structure generally indicated at 30 which forms an important part of my invention. As will be more fully explained herebelow, turbine pump 30 has a housing 31 with an upper surface formed with liquid inlet openings in communication with the bottom of tub 4. Pump 30 also has a pair of outlets 32 and 33 (FIGS. 2 and 3). Outlet 33 communicates through a conduit 34 with a suitable drain (not shown) and outlet 32 communicates with a conduit 35 which in turn leads to a nozzle 36. As will be explained, when motor 20 rotates in the direction to cause spinning of basket 2, pump 30 discharges liquid from tub 4 to outlet 33 and thence to drain, and in the other direction of motor rotation (in which agitation is provided) the pump discharges liquid from tub 4 through outlet 32 and then through conduit 35 and nozzle 36.

Nozzle 36 is positioned to discharge into a filter pan 37 secured on the top portion 38 of agitator 14 so as to be movable therewith. With this structure then, when the motor is rotating so as to provide agitation, pump 30 draws liquid from tub 4 and discharges it to conduit 35 so that the liquid passes from nozzle 36 into filter pan 37 and then down through a number of small openings (not shown) provided in the bottom of the filter pan and back into basket 2. In this manner, the filter pan 37 causes lint, which is separated from the clothes during the washing operation, to be filtered out of the water and thus prevents it from being redeposited on the clothes.

The motor 20, clutch 21, transmission 23, basket 2 and agitator 14 form a suspended washing and centrifuging system which is supported by the stationary structure of the machine (which includes tub 4) so as to permit isolation of vibrations from the stationary structure. It will be understood that such vibrations occur primarily as a result of high speed spinning of basket 2 with a load of clothes therein as mentioned above. Any suitable suspension structure may be used and several are well known in the art of washing machines.

In order to accommodate the movement which occurs between basket 2 and tub 4 without any danger of leakage between them, the stationary tub 4 is joined to the upper part of transmission 23 by a boot member 47. Boot 47 may be of any suitable configuration, many of which are known in the art, to permit relative motion of the parts to which it is joined without leakage therebetween.

Completing now the description of the machine as illustrated in FIG. 1, hot and cold water may be supplied to the machine through conduits 48 and 49 which are adapted to be connected respectively to sources of hot and cold water (not shown). Conduits 48 and 49 extend into a conventional mixing valve structure 50 having solenoids 51 and 52, so that energization of solenoid 51 permits passage of hot water through the valve to a hose 53, energization of solenoid 52 permits passage of cold water through the valve, and energization of both solenoids permits mixing of hot and cold water in the valve and passage of warm water into hose 53. Hose 53 has an outlet 54 positioned to discharge into basket 2 so that when one or both of the solenoids 51 and 52 is energized water enters into basket 2 and tub 4.

The level to which the water rises in the basket and tub may be controlled by any suitable means. One typical means of doing this is to provide an opening 55 (FIGS. 2 and 3) in the pump between outlet openings 32 and 33, the opening 55 being connected through a conduit 56 and a tube 57 to a conventional water level pressure sensitive device 71 which may conventionally be positioned within the backsplasher 58 of machine 1. With such devices, as the water rises in basket 2 and tub 4 it exerts increasing pressure of the column of air trapped in tube 57 and at a predetermined pressure level the column of air then trips the pressure sensitive device to shut off whichever or both of solenoids 51 and 52 may be energized.

Referring now to FIGS. 2, 3, 4 and 5 in conjunction with FIG. 1, turbine pump 30 has a housing which is made up of an upper member 59 and a lower member 60 provided with mating peripheral flanges secured together with a gasket 40 therebetween by a number of threaded members 61. In effect, the two members provide an upper wall 62 and a lower wall 63 which are joined by an annular outer wall 64 so as to form a substantially toroidal pump chamber 65.

The previously mentioned pump outlets 32 and 33 communicate with chamber 65 through channels 99 and 100 located between the impeller 68 and the outlet openings 32 and 33 respectively. A dam 66 is positioned in toroidal chamber 65 between the two channels 99 and 100. The dam 66 substantially blocks the toroidal chamber 65 between the channels leaving, however, enough room for the unimpeded rotation of the blades 67 of an impeller 68 which has its blades 67 extending substantially radially outwardly into the pump toroidal chamber as shown. The positioning of the impeller 68 may be effected in any desired manner. For instance, the impeller may be mounted on a shaft 69 which passes through a seal 70 (FIG. 3) and then extends downwardly into engagement with an end plate 46 of the flexible coupling 29 previously mentioned in connection with FIG.

1. A seal 70 is provided to prevent leakage from the chamber 65 around the impeller. The impeller blades 67 extend in planes at substantially right angles to the plane of rotation of the impeller 68 which is substantially horizontal as shown in the drawing.

Located between the impeller 68 and the first and second outlet openings 32 and 33 and in the interior sidewalls 104 and 106 of the channels 99 and 100, respectively, are first and second inlet openings 72 and 74, respectively. Both of these inlet openings are elongated rectangular shaped as best seen in FIG. 3. To accommodate the rather large inlet openings 72 and 74 the distance between the impeller 68 and the respective outlet openings 32 and 33 is extended and provides for the channels 99 and 100. Each of the inlet openings 72 and 74 have a flapper check valve 76 and 78, respectively, positioned to open and permit liquid flow through the respective inlet openings 32 and 33 in one direction of rotation of the impeller 68 and close to prevent the flow of liquid through the respective inlet openings in the opposite direction of rotation of the impeller, one of said flapper check valves being open when the other is closed.

Figure 5:
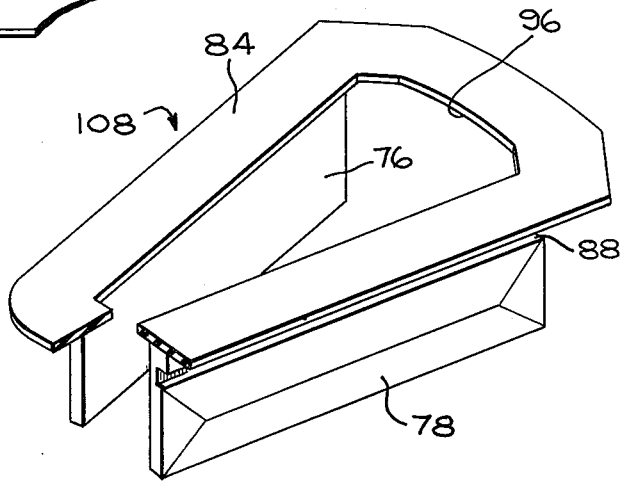
FIG. 5 is a perspective view of the turbine pump integral flapper valve assembly.

In the case of the preferred embodiment, with particular reference to FIG. 5, the flapper check valves 76 and 78 for the respective inlet openings 72 and 74 may be provided by an integral formed assembly 108 carrying both of the flapper check valves. The integral assembly 108 includes a surrounding flange 84 which is perpendicular to each of the flapper check valves 76 and 78 when they are in the closed position. The flapper check valves 76 and 78 are molded with the surrounding flange 84 and have hinge means 86 and 88 where the flapper check valve means 76 and 78 respectively join the surrounding flange 84. In this manner the flapper check valves 76 and 78 are movable back and forth. The rigid frame members 80 and 82 are utilized to retain the integral assembly 108 in its proper configuration and also act as a stop means to prevent movement of the flapper check valves 76 and 78 beyond a vertical position as best seen in FIG. 4. The stop means of the frame members 80 and 82 are shoulders 90 and 92 respectively. As can be seen in FIG. 4, the flapper check valves 76 and 78 may move outwardly from their vertical position shown in FIG. 4 but are prevented from moving inwardly beyond the vertical position as shown in FIG. 4 by the shoulders 90 and 92 of the frame members 80 and 82 respectively.

To accommodate the integral flapper check valve assembly 108 and the rigid frame members 80 and 82, the pump housing 31 is provided with a cavity 94 dimensioned to receive the integral flapper check valve assembly 108 and rigid frame members. When the integral flapper assembly 108 is inserted into the pump housing the flange 84 extends outwardly of the cavity 94. It will be noted that the integral flapper check valve assembly 108 as shown in FIG. 5 has a rather large cavity 96 leading from the flange 84 to the flapper check valves 76 and 78.

The turbine pump 30 is secured to the bottom wall 98 of the tub 4 by any appropriate means and is positioned such that the flange 84 of the integral flapper check valve means is urged against the bottom wall 98 of the tub so that it acts as a liquid seal between the tub 4 and pump 30. The bottom wall 98 of the tub has an opening therethrough (not shown) so that liquid from within the tub is in direct communication with the cavity 96 in the integral flapper check valve assembly 108. In this manner there is a large reservoir of liquid constantly available to the pump during its operation. In this case the reservoir is the liquid containing tub 4.

During operation of the washing machine 1, the pump impeller 68, as viewed in FIG. 2, is turned in a clockwise direction during agitation operations and in a counterclockwise direction during centrifuging or spinning operations. As a result of the clockwise rotation during agitation, liquid is drawn from the reservoir or tub 4 through the cavity 96 in the integral flapper check valve assembly 108 and due to the liquid pressure exerted by the pump 88 flapper check valve 78 moves or swings from its hinge outwardly toward the side of the pump. The liquid passes through inlet opening 74, through channel 100 toward the impeller 68 and then is pumped around via toroidal space 65 to channel 99, the liquid being diverted by the dam 66 into the channel 99. During this direction of rotation of the impeller the flapper check valve 76 is caused by the water pressure to be moved to a vertical position and stopped by shoulder 90 of the rigid frame member 80 to thus close inlet opening 72 and prevent liquid from passing through the inlet opening 72.

Referring back to FIG. 1, it will readily be seen that flow out through outlet 32 is recirculated by being passed through nozzle 36 into filter pan 37 and then back into the tub 4. When the direction of the pump is reversed by the motor 20 being reversed, the pump 30 draws liquid through inlet 72 and passes it out through outlet 33. In this direction of rotation (counterclockwise as viewed in FIG. 2) the liquid is discharged from the machine via conduit 34.

It is an important aspect of this invention that the inlet openings 72 and 74 be dimensioned to flow liquid through those openings during operation of the impeller 68 in a volume greater than the capacity of the impeller 68 to move the liquid through the toroidal space to the respective outlets 32 or 33. In this manner then liquid will always be available to the impeller and will in effect flood the pump chamber with liquid so that there is no possibility of air being sucked from either of the outlet openings 32 or 33 depending upon the direction of rotation of the impeller 68. Also, it is important that there is a liquid reservoir, which in this case is the tub 4, in direct communication with the flapper check valves 76 and 78 and opening 96 so that there is always a supply of liquid which is at least equal to the volume capacity of the inlet openings 76 and 78 to allow the flow of liquid into the pump chamber 65.

By the above-described reversible turbine pump assembly effective operation in either direction of rotation of the pump impeller is obtained with no air sucking or locking. The reason is that the outlet opening that would normally be experiencing suction (outlet 32 during counterclockwise rotation and outlet 33 during clockwise rotation) will not be caused to have air drawn through it into the impeller chamber 65 because the impeller chamber is constantly full of liquid during the pump operation.

It will be understood that the flapper check valves 76 and 78 may be made from any appropriate material which allows them to be movable as a flapper and is suitable in the environment for which it is intended.

The opening 55 which is in direct communication with the cavity 96 or interior of the integral flapper check valve assembly 108 is employed in the preferred embodiment for supplying water pressure to the water level pressure switch means. This is possible because the water pressure at the outlet opening 55 represents the head of the water pressure within the reservoir or tub 4 since it is located between the inlet openings 72 and 74 and the tub 4. The opening 55 does not affect the operation of the turbine pump as heretofore described.

The foregoing is a description of the preferred embodiment of the invention and variations may be made thereto without departing from the true spirit of the invention, as defined in the appended claims.

What is claimed is:

1. A reversible turbine pump for producing a bi-directional liquid flow comprising:

(a) a housing having a substantially annular outer wall and top and bottom walls closing the ends of the outer wall;

(b) a bi-directional rotatable impeller within the housing having an annular series of blades extending outwardly and forming with said walls a substantially toroidal space;

(c) first and second spaced outlet openings;

(d) first and second circumferentially spaced channels between the impeller and each of the outlet openings in liquid flow communication with the toroidal space;

(e) a dam between said channels; and (f) an inlet opening located in each of said channels, each of said inlet openings having a flapper check valve arranged to open and permit liquid flow through the inlet opening in one direction of rotation of the impeller and close to prevent the flow of liquid through the opening in the opposite direction of rotation of the impeller, one of said flapper check valves being open when the other is closed during impeller rotation, said inlet openings being dimensioned to flow liquid therethrough in a volume greater than the capacity of the impeller to move the liquid through the toroidal space; and (g) a liquid reservoir arranged to supply liquid to the inlet openings at least equal to the inlet opening liquid flow through volume.

2. The turbine pump of claim 1 wherein the inlet openings are located in the interior sidewall of each of the channels and extend from the outlet opening to the dam.

3. The turbine pump of claim 2 wherein the inlet openings are rectangular shaped.

4. The turbine pump of claim 1 wherein the flapper check valve for both inlet openings is an integrally formed assembly with a V-shaped cavity between the two flapper check valves.

5. The turbine pump of claim 4 wherein the integral flapper check valve assembly includes a continuous flange perpendicular to the flapper check valves when they are in the closed position.

6. The turbine pump of claim 1 wherein insertable rigid opening frames surround each of the openings.

7. The turbine pump of claim 6 wherein the frames provide stop means for the flapper check valve in the closed position.

8. In a clothes washing machine having means for washing the clothes and for extracting liquid from said clothes, a liquid-containing tub, a reversible pump, a motor, a filter, means including the pump to recirculate water from the tub through the filter and back into the tub, and means including the pump to discharge liquid from the tub to drain, the improvement comprising a reversible turbine pump having;

(a) a housing having a substantially annular outer wall and top and bottom walls closing the ends of the outer wall;

(b) a bi-directional rotatable impeller within the housing having an annular series of blades extending outwardly and forming with said walls a substantially toroidal space;

(c) first and second spaced outlet openings;

(d) first and second circumferentially spaced channels between the impeller and each of the outlet openings in liquid flow communication with the toroidal space;

(e) a dam between said channels;

(f) an inlet opening located in each of said channels, each of said inlet openings having a flapper check valve arranged to open and permit liquid flow through the inlet opening in one direction of rotation of the impeller and close to prevent the flow of liquid through the opening in the opposite direction of rotation of the impeller, one of said flapper check valves being open when the other is closed during impeller rotation, said inlet openings being dimensioned to flow liquid therethrough in a volume greater than the capacity of the impeller to move the liquid through the toroidal space; and (g) a liquid reservoir arranged to supply liquid to the inlet openings at least equal to the inlet opening liquid flow through volume.

9. In the clothes washing machine of claim 8 wherein the inlet openings of the turbine pump are located in the interior sidewall of each of the channels and extend from the outlet opening to the dam.

10. In the clothes washing machine of claim 8 wherein the inlet openings of the turbine pump are rectangular shaped.

11. In the clothes washing machine of claim 8 wherein the turbine pump has an opening between the inlet openings and the reservoir for communication with a water level pressure sensitive switch.

12. In the clothes washing machine of claim 8 wherein the flapper check valve for both inlet openings of the turbine pump is an integrally formed assembly with a V-shaped cavity between the two flapper check valves.

13. In the clothes washing machine of claim 8 wherein the turbine pump has insertable rigid opening frames which surround each of the openings.

14. In the clothes washing machine of claim 13, wherein the turbine pump frames provide stop means for the flapper check valve in the closed position.

15. In the clothes washing machine of claim 8 wherein the liquid reservoir is the machine tub.

16. In the clothes washing machine of claim 15 wherein the integral flapper check valve assembly includes a continuous flange perpendicular to the flapper check valves when they are in the closed position and acts as a liquid seal between the pump inlets and the machine tub.

* * * * *